United States Patent [19]

Ilsemann

[11] Patent Number: 4,747,905

[45] Date of Patent: May 31, 1988

[54] LABELLING APPARATUS

[76] Inventor: Heino Ilsemann, Am Wehkamp 3, 2800 Bremen 1, Fed. Rep. of Germany

[21] Appl. No.: 908,194

[22] Filed: Sep. 17, 1986

[30] Foreign Application Priority Data

Sep. 17, 1985 [DE] Fed. Rep. of Germany ..... 3533059

[51] Int. Cl.[4] ..... B44C 1/00; B65C 9/00; B65C 9/08

[52] U.S. Cl. ..... 156/542; 156/567; 156/568; 156/570; 156/DIG. 33

[58] Field of Search ..... 156/361, 350, 351, 540, 156/541, 566, 567, 568, 584, 249, 240, DIG. 33, 360, 542, 570, 497, DIG. 37; 271/162, 171, 109, 269

[56] References Cited

U.S. PATENT DOCUMENTS

| | | | |
|---|---|---|---|
| 3,544,412 | 12/1970 | Arvidson et al. | 156/360 |
| 4,276,112 | 6/1981 | French et al. | 156/542 |
| 4,302,277 | 11/1981 | Ilsemann | 156/567 |
| 4,324,608 | 4/1982 | Klinger | 156/361 |

FOREIGN PATENT DOCUMENTS 2826035 10/1981 Fed. Rep. of Germany .

*Primary Examiner*—Donald E. Czaja
*Assistant Examiner*—Louis Falasco
*Attorney, Agent, or Firm*—Hill, Van Santen, Steadman & Simpson

[57] ABSTRACT

An apparatus for labelling tape cassettes which are being conveyed in an upright condition on a straight essentially horizontal path between label applying devices on each side of the path characterized by each of the label applying devices having the arrangement for providing strip labels to a label holder of the device and an arrangement for aligning each of the strip labels on the holder in the exact application position. One embodiment of the invention has each of the label applying devices include two rotatable turrets with one turret applying the strip label at a different height on the cassette from the other turret. In another embodiment, a single turret has two strip label applying stations which apply the label at different heights on the label holder so that two strip labels are applied on each side simultaneously.

16 Claims, 3 Drawing Sheets

LABELLING APPARATUS

The invention relates to an apparatus for labelling tape cassettes, comprising a conveyor means conveying the tape cassettes upright on a straightline essentially in an horizontal direction to which the tape cassettes are suppliable from a supply magazine, and comprising label-applying devices arranged to be opposite one another on both sides of the conveyor means. Each of the label-applying devices comprises a radially movable label holder having vertical suction faces, said label holders being arranged on a turret head rotating around a vertical axis and being successively suppliable to a label feeding station, to a preparation station and to a labelling station.

German Pat. No. 28 26 035 discloses an apparatus of this species which is intended for labelling the tape cassettes by means of normal labels, whereby such normal labels are distinguished in that they respectively cover one of the broad side faces of the tape cassettes essentially completely, leaving, of course, the respective openings for the cassette drive free. The known labelling apparatus is thereby preferably intended for employment of labels to be provided with glue in the preparation station.

Recently, the idea of no longer gluing normal labels of the type set forth above but only one or two strip labels which respectively proceed parallel to the long edges of the tape cassette at only one side of the openings for the cassette drive has been gaining in acceptance. The strip labels are thereby fashioned self-adhesive and are glued to a carrier tape of paper or the like. Up to now, the arrangement of the strip labels on the carrier tape has been such that they are arranged in longitudinal direction, i.e. parallel to the feed direction of the carrier tape, whereby this arrangement is also used given known, self-adhesive normal labels. What is disadvantageous given this arrangement of the self-adhesive strip labels on the carrier tape is the consumption of carrier tape material that arises. Given the known apparatus, further, there is no possibility of being able to optionally glue different strip labels or normal labels to the tape cassettes in a simple way.

It is therefore the object of the invention to improve the apparatus of the species to the effect that, given the greatest possible savings of carrier tape material and strip label material with a high clock rate, self-adhesive strip labels as well as self-adhesive normal labels can be optionally applied to tape cassettes.

In an apparatus of the said species, this object is achieved in accord with the invention in that, for applying self-adhesive strip labels, every label applying device comprises at least one strip label feeder station to which strip labels glued on an elongated carrier tape of paper or the like at a right angle relative to the feed direction thereof are suppliable, these strip labels being transferable in the label feeder station onto the suction faces of the label holders in a position essentially corresponding to the intended application position and having the adhesive surface directed radially out; and in that the preparation station is fashioned as an alignment station for aligning the strip labels arranged on the label holders into the exact application position.

A preferred embodiment of the invention provides that, in the strip label feeder station, the strip labels are transferable onto the suction faces of the label holders in a position that is slightly vertically offset relative to the intended application height and can be shifted exactly into the application height in the alignment station.

It can also be provided that every label applying device comprises two turret heads arranged following one another in a conveying direction of the conveyor means and comprising at least one allocated strip label feeder station.

A further embodiment of the invention thereby provides that each of the turret heads has a strip label feeder station allocated to it, whereby, in each of the strip label feeder stations of the respective label applying device, the strip labels are transferable onto the suction faces of the respective label holders in differing, approximate application height.

On the other hand, it can also be provided in accord with the invention that every label applying device comprises a turret head having two strip label feeder stations arranged following one another, whereby the strip labels in each of the strip label feeder stations are transferable onto the suction faces of the respective label holders in differing, approximate application height.

A further embodiment of the invention is characterized in that every label applying device comprises a normal label feeder station to which self-adhesive normal labels glued to an elongated normal label carrier tape at a right angle relative to the feed direction.

The invention also proposes that the alignment station comprises an adjustable ram or the like for the alignment of the strip labels.

It can thereby be provided that the ram comprises two alignment projections for respectively one of two strip labels arranged on the label holder at different heights.

It can thereby also be provided that the label holders are provided with an alignment recess cooperating with one of the alignment projections of the ram.

Enormous savings of carrier tape material can be achieved by means of the inventive measure of being able to glue the strip labels on at a right angle relative to the feed direction as a result of the design. The apparatus of the invention is extraordinarily flexible and allows tape cassettes to be optionally glued with strip labels at different levels just as it allows the optional employment of normal labels. Overall, the set-up and operating costs for operations, etc., which label tape cassettes can be drastically reduced in this way, whereby the advantages of the apparatus with respect to reliability and high clock rate correspond to those of the apparatus of the species.

Further features and advantages of the invention derive from the following description in which exemplary embodiments of the invention are set forth in detail with reference to the schematic drawing. Thereby shown are:

Figure 1:
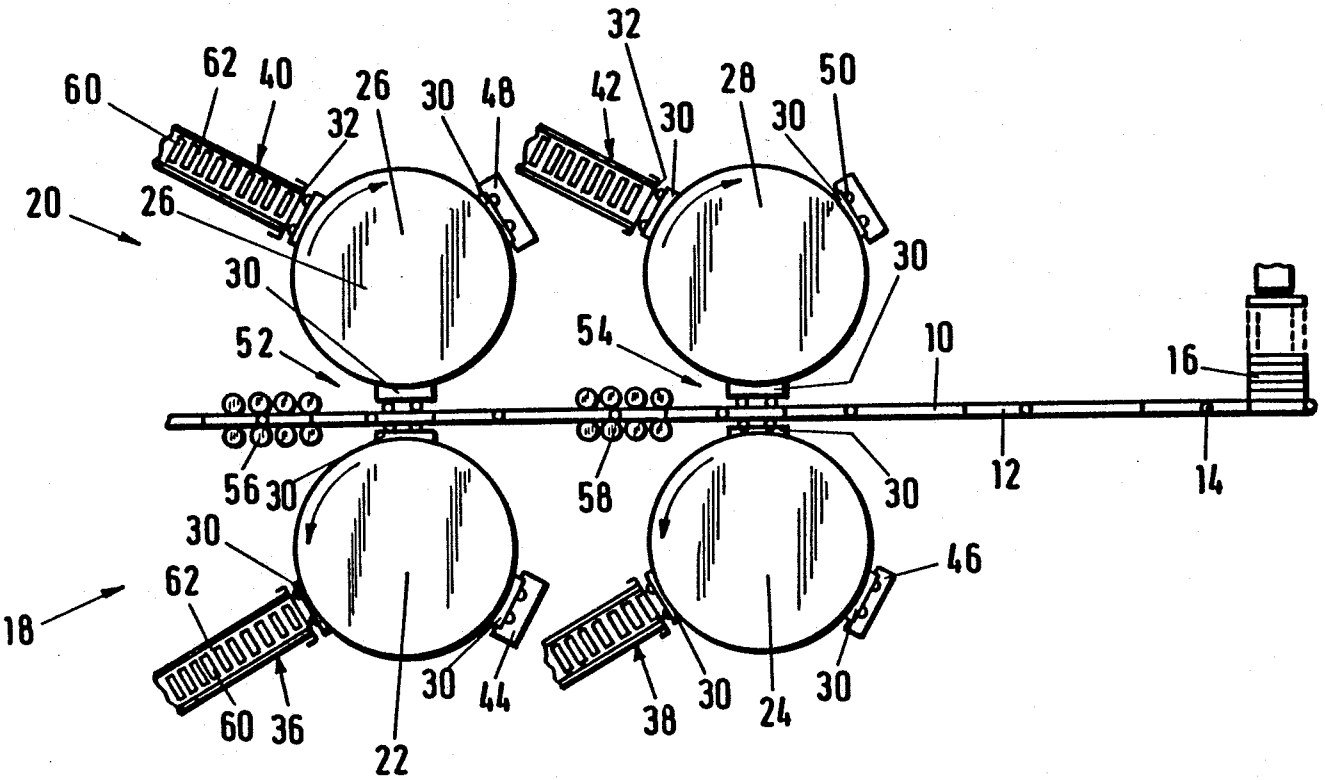
FIG. 1 is a plan view an exemplary embodiment of an apparatus of the invention.

As FIG. 1 shows, the apparatus of the invention (given the illustrated exemplary embodiment) comprises a conveyor chain 10 moving from right to left for tape cassettes 12 which, standing upright on the conveyor chain 10 by means of cams 14 rising therefrom, are supplied from a supply magazine 16 to two label applying devices, each of the latter comprising two turret heads 22,24 or, respectively, 26,28 which are arranged with a vertical rotational axis. At its circumference, each of the turret heads 22,24,26,28 comprises three label holders 30 which are provided with suction faces that are tangential with respect to the respective turret head 22,24,26,28 and are also provided with centering pins 32. Arranged respectively following one another in the rotational direction (indicated by an arrow) at the circumference of each of the turret heads 22,24,26,28 are a strip label feeder station 36,38,40,42, an alignment station 44,46,48,50, as well as labelling stations 52,54 respectively allocated to one pair of turret heads 22,26 or, respectively, 24,28 lying opposite one another with respect to the conveyor chain 10, these labelling stations 52,54 comprising pressure rollers 56,58 following the application location. Self-adhesive strip labels 60 which are respectively glued to a carrier tape 62 at a right angle relative to the feed direction thereof which is directed toward the respective turret head 22,24,26,28 are supplied in each of the strip label feeder stations 36,38,40,42.

Figure 2:
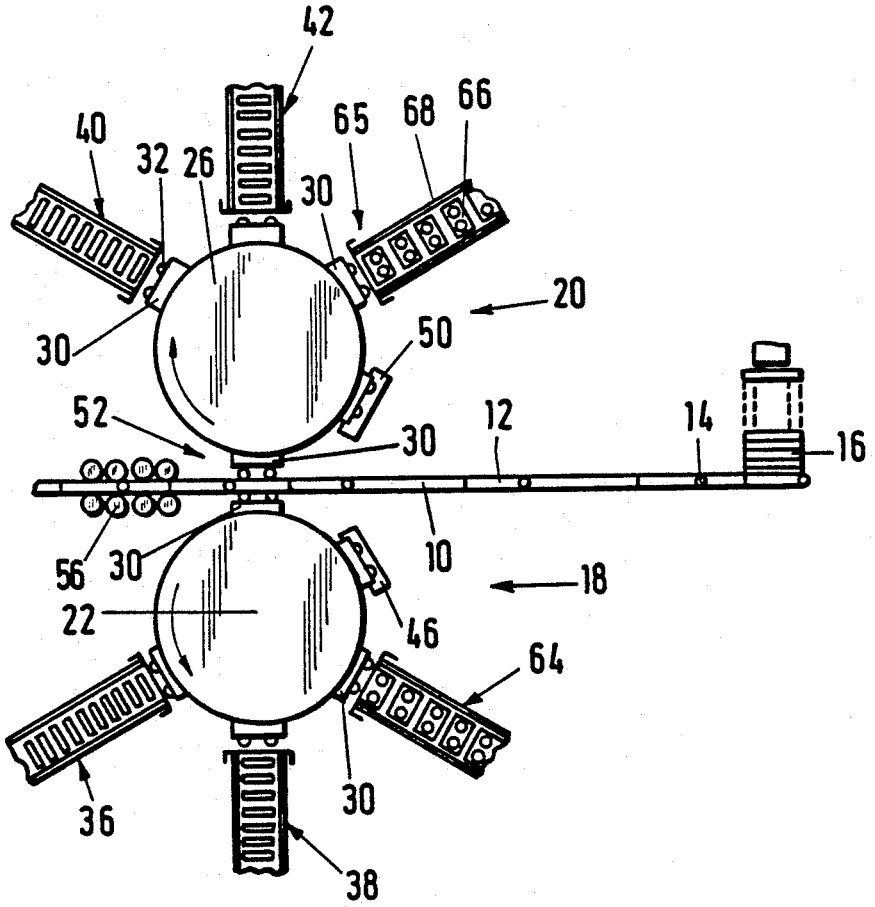
FIG. 2 is a plan view another exemplary embodiment of the apparatus of the invention.

The exemplary embodiment shown in FIG. 2 differs from that of FIG. 1 in that only two turret heads 22,26 lying opposite one another with respect to the conveyor chain 10 are provided. The two heads 22, 26 are provided with two strip label feeder stations 36,38 or, respectively, 40,42, a normal label feeder station 64 or 65 to which normal labels 66 likewise fashioned self-adhesive and glued to a normal label carrier tape 68 at a right angle relative to the feed direction thereof are suppliable, as well as the alignment stations 46 and 50 respectively following one another in rotational direction being allocated to these turret heads 22,26.

Figure 3:
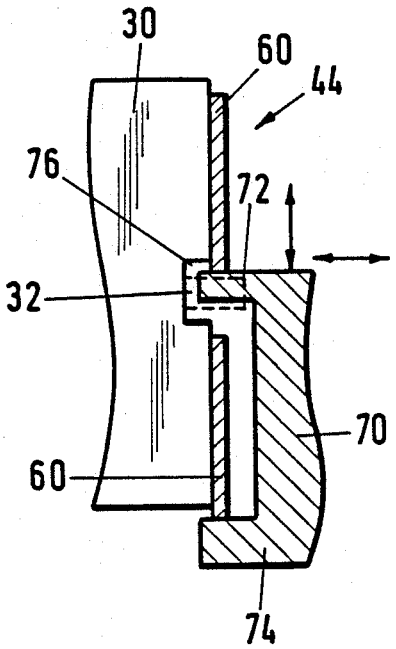
FIG. 3 is a partial cross sectional view of an alignment station of the apparatus of FIG. 1 or FIG. 2 in a schematic vertical section radially with respect to the turret head.

As FIG. 3 shows, the alignment station 44 therein comprises a ram 70 movable both vertically as well as horizontally in the direction of the arrows which is provided with two alignments projections 72,74 arranged vertically above one another which are each allocated to a strip label 60. The strip labels 60 are seated on the label holder 30 at different heights, whereby the latter comprises an alignment recess 76.

Figure 4:
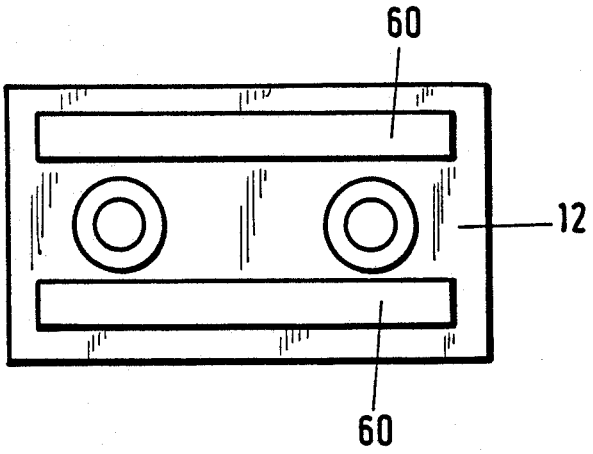
FIG. 4 is a plan view of a tape cassette with strip labels glued thereon.

FIG. 4, finally, shows the strip labels 60 glued to the tape cassette 12 shown therein at different heights.

The apparatus of the invention functions with respect to the tape cassette transport, the labelling stations, the turret head circuit, etc., in a fashion very similar to that set forth, for example, in German Pat. No. 28 26 035 for the labelling apparatus disclosed therein. With respect to the invention-oriented features, the exemplary embodiments of the apparatus of the invention set forth above and shown in the drawing function in the following way:

In the apparatus of FIG. 1, devices (not shown) in the strip label feeder stations 36,38,40,42 transfer strip labels 60 from the carrier tape 62 onto the suction face of the respective label holder 30, whereby, for example, the strip label feeder stations 36,40 apply respective strip labels 60 for the application position shown at the bottom in FIG. 4, whereas the strip label feeder stations 38,42 transfer the strip labels situated at the top in FIG. 4 onto the respective label holder 30. The centering pins 32 are not required in this exemplary embodiment. In the respective alignment stations 44,46 or, respectively, 48,50, the strip labels 60 situated on the label holders 30 are brought exactly into that position which corresponds to the later application position in accord with FIG. 4 and are then glued to the tape cassettes 12 at both sides in the labelling stations 52,54, whereupon the further pressing by means of the pressure rollers 56,58 then also ensues. Overall, thus, the cassettes then carry strip labels of the kind shown in FIG. 4 after they have passed the labelling apparatus of FIG. 1.

In the exemplary embodiment of FIG. 2—leaving the normal label feeder stations 64,65 out of consideration for the moment—, the strip label feeder stations 36,35 or, respectively, 40, 42 given a manner of functioning that is other wise similar to that in the exemplary embodiment of FIG. 1 transfer two strip labels 60 in differing height (seen in FIG. 4) onto the label holders 30 in respective succession, whereupon the height alignment of the strip labels 60 initially applied to the suction faces of the label holders 30 slightly offset relative to their application height then ensues in the alignment stations 46,50 by means of the device shown in FIG. 3. Subsequently, both strip labels 60 of every side of the tape cassette 12 are simultaneously pressed against the respective tape cassette 12 in the single labelling station 52 and are firmly pressed on by means of the pressure rollers 56 therein. Given inactivation of the strip label feeder stations 36,38,40,42 in the exemplary embodiment of FIG. 2, however, normal labels 66 can also optionally be applied instead of the strip labels 60, namely by means of the normal label feeder stations 64,65 which are then in operation, whereby the centering pins 32 are used in the way set forth in German Pat. No. 28 26 035 and the application of the normal labels ensues in the way set forth therein.

Given the illustrated exemplary embodiments, the apparatus of the invention can, of course, also be operated such that only a single strip label is applied to one of the sides or to each of the two sides of the respective tape cassette 12. In a known way, it is also possible to provide an additional moistening station and, under given conditions, to provide labels still to be moistened with adhesive or binder fluid instead of the self-adhesive glued labels provided in accord with the invention.

The features of the invention disclosed in the above specification, in the drawing as well as in the claims can be essential both individually as well as in arbitrary combinations for the realization of the invention in terms of its various embodiments.

What is claimed is:

1. In an apparatus for labelling tape cassettes, said apparatus including a supply magazine for the tape cassettes, a conveyor means for conveying the tape cassettes upright along an essentially horizontal straight line direction from the supply magazine, label applying devices being arranged on opposite sides of the conveyor means, each of said label applying devices including a radially movable label holder having vertical suction faces being mounted on a turret head rotating around a vertical axis to present the holder in succession to a label feeding station, a preparation station, and a labelling station, the improvements comprising for applying self-adhesive strip labels, each label applying device including at least one strip label feeder station, said strip label feeder station having means for conveying a carrier tape with the strip label attached to the tape to extend at a right angle relative to a direction of feed of the tape, and means for transfering the labels from the tape onto a suction face of the label holder in a position which is vertically offset slightly relative to the intended application height for the strip label; and the preparation station including an alignment station having means for engaging an edge of the strip labels and moving the strip label from the vertically offset position to the exact application height position on the suction face of the label holder.

2. In an apparatus according to claim 1, wherein each of the labelling devices includes two turret heads arranged one following the other along the conveyor means, each of the turret heads having a strip label feeder station.

3. In an apparatus according to claim 2, wherein each of the two turret heads of each label applying device has a strip label feeder station allocated to it, the strip label feeder station for one of the two turret heads applies the strip label at a different height than the feeder station for the other turret head so that two strips are applied on each side of the cassette by the two turret heads.

4. In an apparatus according to claim 2, wherein the alignment station includes an adjustable ram movable in two directions having the means for engaging the edge label to shift it from the offset position to the aligned vertical position.

5. In an apparatus according to claim 4, wherein the means for engaging on the ram comprises two aligned projections for respectively engaging edges of strips applied on the label holder.

6. In an apparatus according to claim 5, wherein the label holder is provided with an alignment recess cooperating with the two projections of the ram.

7. In an apparatus according to claim 2, wherein each of the label applying devices includes a normal label feed station on which self-adhesive, normal labels are attached on an elongated carrier tape at right angles relative to a feed direction of the tape to be supplied to the label holder.

8. In an apparatus according to claim 1, wherein the alignment station includes a ram having the means for engaging a strip label, said ram being adjustable in two directions.

9. In an apparatus according to claim 8, wherein the ram has two alignment projections for engaging edges of labels arranged on the label holder at different heights.

10. In an apparatus according to claim 9, wherein the label holder has an alignment recess on the suction face for cooperating with the alignment projections of the ram.

11. In an apparatus according to claim 1, wherein each of the label applying devices includes a normal label feed station having means for transporting normal labels glued on an elongated label carrier at right angles relative to a direction of feed for the carrier, said normal label feed station supplying labels to the holder of the label applying device.

12. In an apparatus according to claim 1, wherein each of the label applying devices comprises a single turret head having two strip label feed stations arranged one following the other, one of the two stations applying a strip label to the suction face of the respective label holder at a vertically offset position relative to the strip from the other feed station so that two strip labels are applied to a side of the cassette by one holder.

13. In an apparatus according to claim 12, wherein each of the label applying devices includes a normal label feed station having means for conveying an elongated carrier tape having normal labels attached to the carrier tape at right angles relative to a direction of feed for the tape, said normal label feed station providing normal labels for application to the label holder for applying on a cassette.

14. In an apparatus according to claim 12, wherein the alignment station includes an adjustable ram movable into and out of contact with the suction face of the label holder and parallel thereto, said adjustable ram having means for engaging each of the two labels on said face to move them to the application height.

15. In an apparatus according to claim 14, wherein the means on the ram comprises two aligned groups of projections for the two strip labels on the holder.

16. In an apparatus according to claim 15, wherein the label holder is provided with an alignment recess cooperating with one of the aligned groups of projections of the ram.

* * * * *